US005492269A

United States Patent [19]

Sung

[11] Patent Number: 5,492,269

[45] Date of Patent: Feb. 20, 1996

[54] COLLAPSIBLE/FOLDABLE CONTAINER

[75] Inventor: Joseph Sung, Keelung, Taiwan

[73] Assignee: Sunglare Merchandising Inc., Keelung, Taiwan

[21] Appl. No.: 233,300

[22] Filed: Apr. 26, 1994

[51] Int. Cl.[6] ..... B65D 5/36

[52] U.S. Cl. ..... 229/117.06; 229/405

[58] Field of Search ..... 229/117.01, 117.05, 229/117.06, 405, 123; 383/120

[56] References Cited

U.S. PATENT DOCUMENTS

| | | | |
|---|---|---|---|
| 715,026 | 12/1902 | Crawford | 229/117.05 |
| 1,255,133 | 2/1918 | Carr | 229/405 |
| 2,361,876 | 10/1944 | Schell | 229/117.05 X |
| 3,580,473 | 5/1971 | Gill | 229/104 X |
| 3,945,561 | 3/1976 | Strebelle | 229/117.06 |
| 5,292,058 | 3/1994 | Zoss et al. | 229/123 |

FOREIGN PATENT DOCUMENTS

| | | | |
|---|---|---|---|
| 204621 | 4/1993 | China . | |
| 1302573 | 7/1962 | France | 229/117.05 |
| 2279624 | 2/1976 | France | 229/117.05 |
| 1603429 | 11/1981 | United Kingdom | 229/117.05 |

*Primary Examiner*—Gary E. Elkins
*Assistant Examiner*—Christopher J. McDonald
*Attorney, Agent, or Firm*—Jacobson, Price, Holman & Stern

[57] ABSTRACT

A collapsible or foldable container formed by sheet material comprising at least a bottom (15), a first pair of opposite side walls (12) (14) and a second pair of opposite side walls (11) (13). The bottom (15) and the second pair of side walls (11) (13) are respectively provided with folding guider means along their middle lines (42) (29) (32) which are coplanar. Also the two legs of two respective isosceles triangles defined by two isosceles triangular zones at the lower part of the two side walls (11) (13) are also provided with folding guider means. Thus the container can be easily collapsed into a planar structure to facilitate its carrying, storage, transport or disposal.

9 Claims, 10 Drawing Sheets

COLLAPSIBLE/FOLDABLE CONTAINER

The present invention relates to a disposable container which can be easily stretched up from its collapsed state for use and easily folded to a planar structure after use, and more particularly, to a cup or container formed by sheet material. The sheet can be aluminum foil, paper, or compound. Though plastic material can also be used, they had better be avoided for the sake of environmental protection. The container, when in collapsed state, has a planar structure and occupies very little space, thus greatly reducing the required space for storage, disposal and the cost for transportation. In use, the flat structure can be easily folded to build a container, which, after use, can be easily crushed flat back to its planar form, thereby largely facilitating its disposal or recycling.

Though the conventional disposable container, for example, paper cups or foam bowls, can be stacked or nested in an array, a thus resulted stack is still relatively bulky because each individual container cannot be crushed thoroughly into an enough planar structure. After use, such a container, if not crushed, is too bulky for a convenient disposal. One has to spend a considerable strength to crush the relatively rigid form of the container, and even this fails to make it sufficiently flat. Besides, such containers are relatively inconvenient to carry because they are vulnerable to unexpected impact while the present invention, usually carry, store and transport in its planar form, ensures easy, safe and economic carrying, storage and transportation.

A collapsible paper cup was known to comprise two pieces which define a flat structure, with an opening for filling in liquids or other objects. The flat structure enables the container to be advantageously stacked and transported, and easily disposed after use. The disadvantage of the known collapsible/crushable cup consists in that it lacks structural rigidity and cannot stand upright, and is therefore very unstable and insecure in use.

The above-mentioned containers all belong to open types. As for close-type disposable containers, the problems are still more serious since a close-type container is far more difficult to crush than an open type, and a space-saving stacking is totally impossible in the former's case.

Accordingly, it is the object of the present invention to provide a disposable container, of either open type or close type, which can be easily collapsed or folded into a planar structure to facilitate its carrying, storage, transportation and disposable without thereby sacrificing its structural rigidity which supports it to stand upright in use.

According to the present invention, this object is achieved by a container of which the bottom (or both the top and the lower bottom, in case of close-type) is square or rectangular and can be folded along a middle line inwardly to lie flat in a plane, and a pair of opposite side walls of the container can be folded along their respective middle line outwardly so that the two pairs of side walls are all in a common plane which includes the folded bottom(s), thus giving the desired planar structure.

In order to simultaneously enable the inward folding of the bottom(s) and the outward folding of the pair of side walls without any resistance, at least one pair of side walls and the bottom(s) must be partly folded inwardly. The zones which are to be folded inwardly are identically isosceles triangles and respectively located at the lower part of each of the two side walls and conjoined with two corresponding opposite ends of the bottom(s).

To facilitate the folding operation of the container, the aforesaid middle lines of the bottom(s) and of the two opposite side walls are so mechanically treated by any conventional means that a stress applied to the bottom(s) or to the side walls will be concentrated along the middle lines. The treatments can be the formation of indentations, scratches, roulettes (perforated lines) or folding lines (all of which are generally referred to as "folding guider") to ensure the folds to occur along the middle lines.

According to another feature of this invention, within the isosceles triangle areas, parallel spaced scores perpendicular to the middle lines (folding guiders) or slantly branched out from the middle lines are provided to further facilitate a fold to occur along a folding line.

According to still another feature of this invention, a folding line can be provided along a vertical middle line of each of a second pair of side walls, with the folding line extending through a portion or whole length of the middle line, thus enabling the container to have an octagonal brim which is closer to a circular brim and therefore more comfortable to hold than a tetragonal brim.

This invention will become apparent when read in connection with various embodiments illustrated in the drawing, in which.

Figure 1:
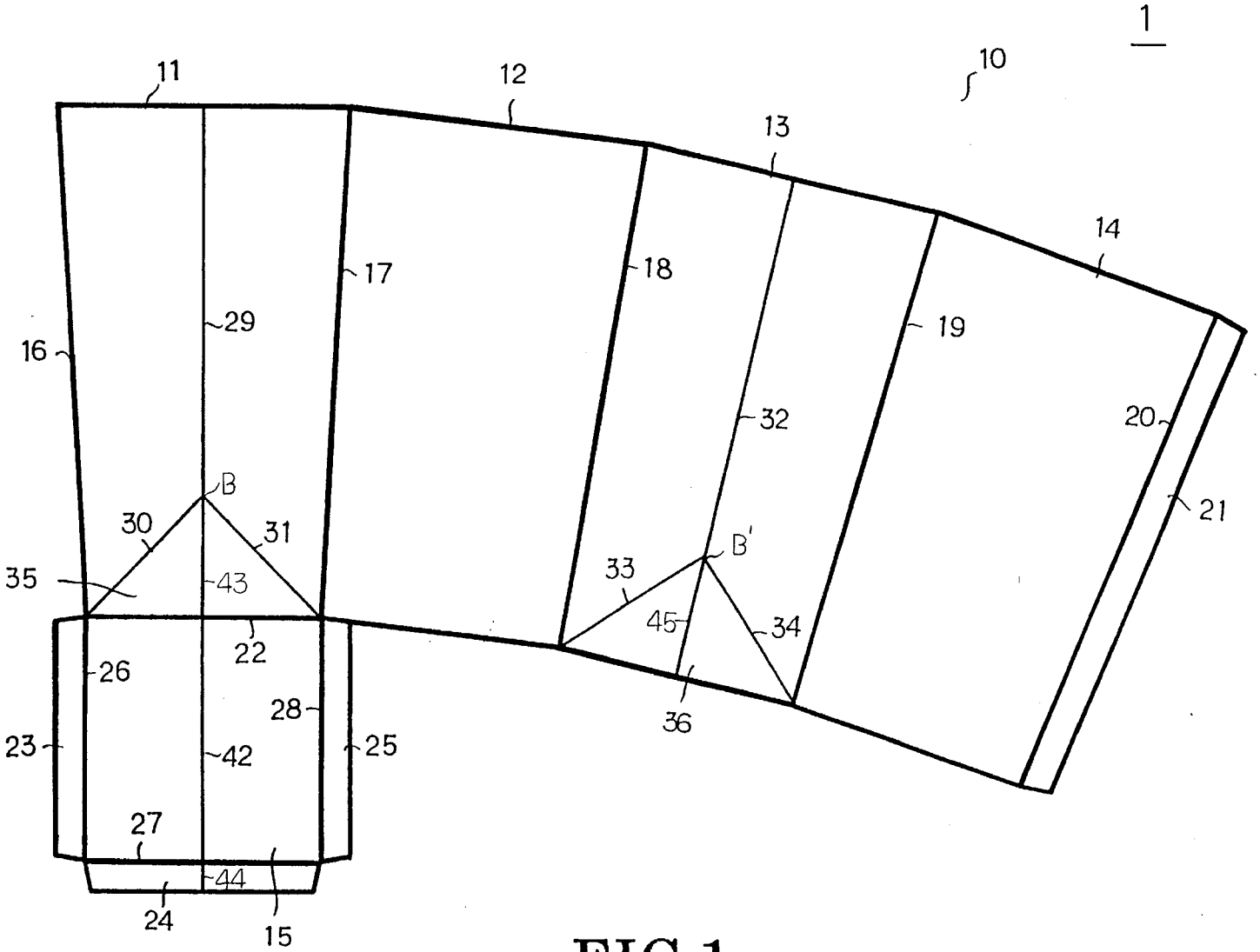
FIG. 1 is a plan view of a blank of an open-type container according to a simplest embodiment of this invention.
Figure 3:
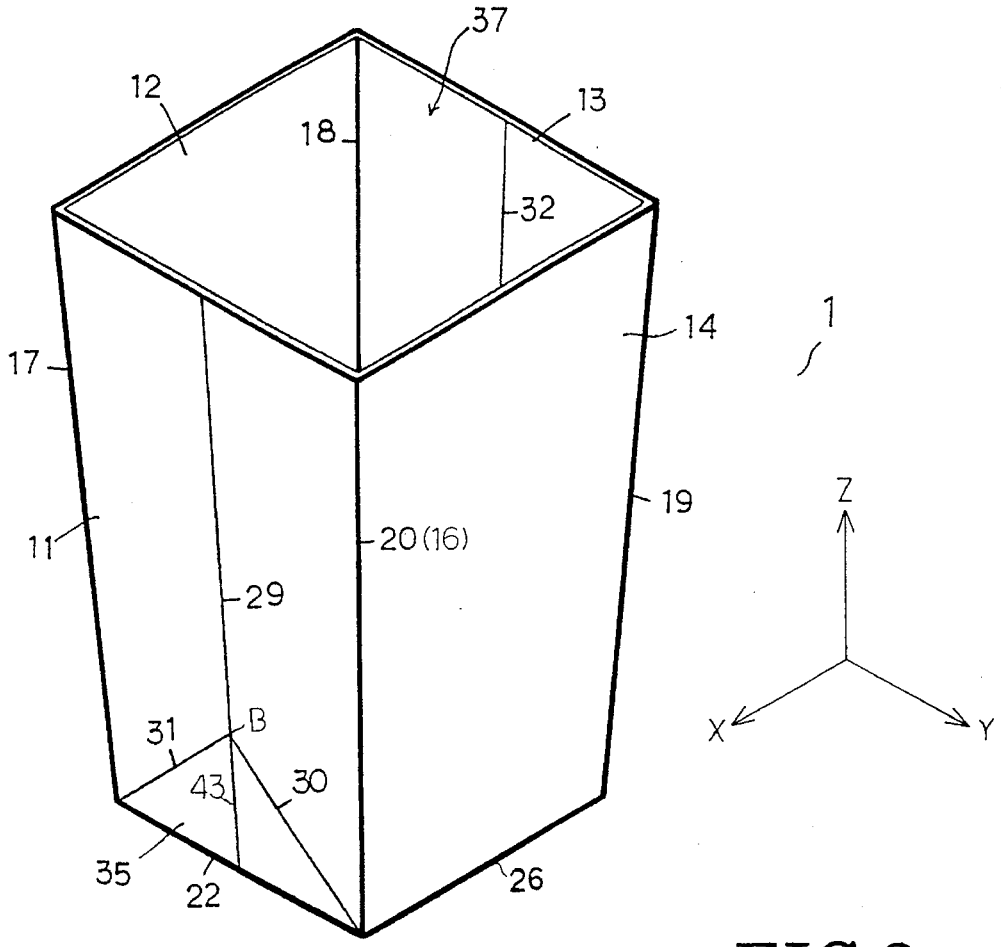
FIG. 3 is a perspective view of a container formed by the blank of FIG. 1 in erected state.

Referring to FIG. 1, an open-type container (1) according to this invention comprises, as in the case of the conventional containers, four side walls (11) (12) (13) and (14), and a bottom (15), as well as tabs (21), (23), (24) and (25), with the borders between each two adjacent side walls forming the folding lines (17) (18) (19). [Of course, the bottom (15) can alternatively be formed as a separate part instead of an integral part of the blank.] The blank can be folded in conventional way into a container (1) in FIG. 3. The characteristic feature of the container consists in the formation of folding guiders which include two respective middle lines (29) (32) of a first pair of opposite side walls (11) (13), a middle line (42) of the bottom (15), and the two pairs of legs (30) (31) (33) (34) of two isosceles triangles (35) (36) on the two opposite sides (11) (13).

Figure 2:
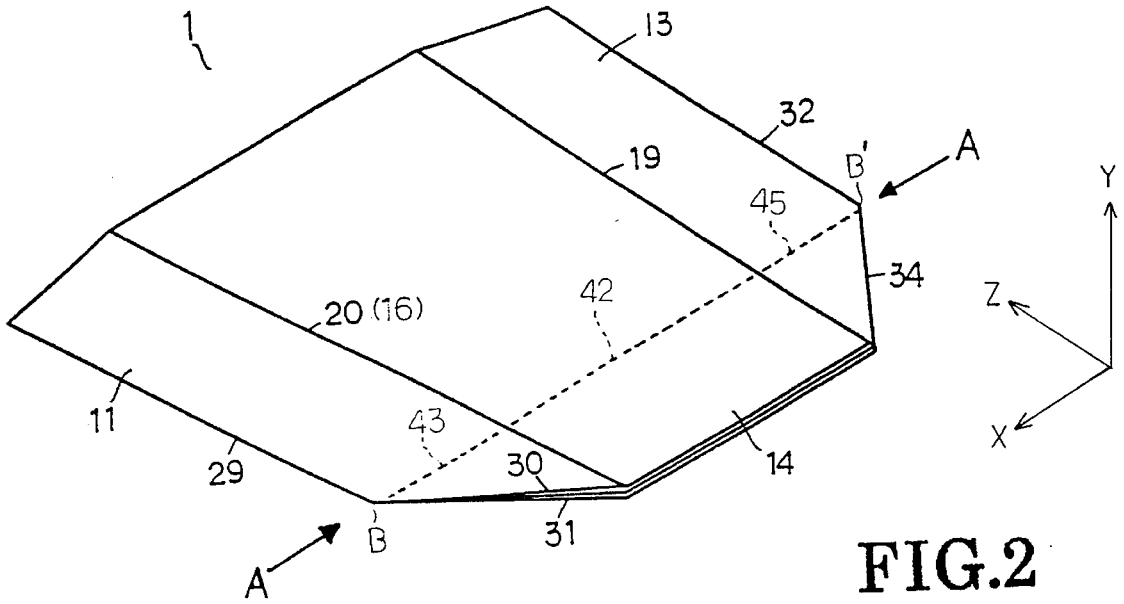
FIG. 2 is a perspective view of the container formed by the blank of FIG. 1 in collapsed or crushed state.
Figure 4:
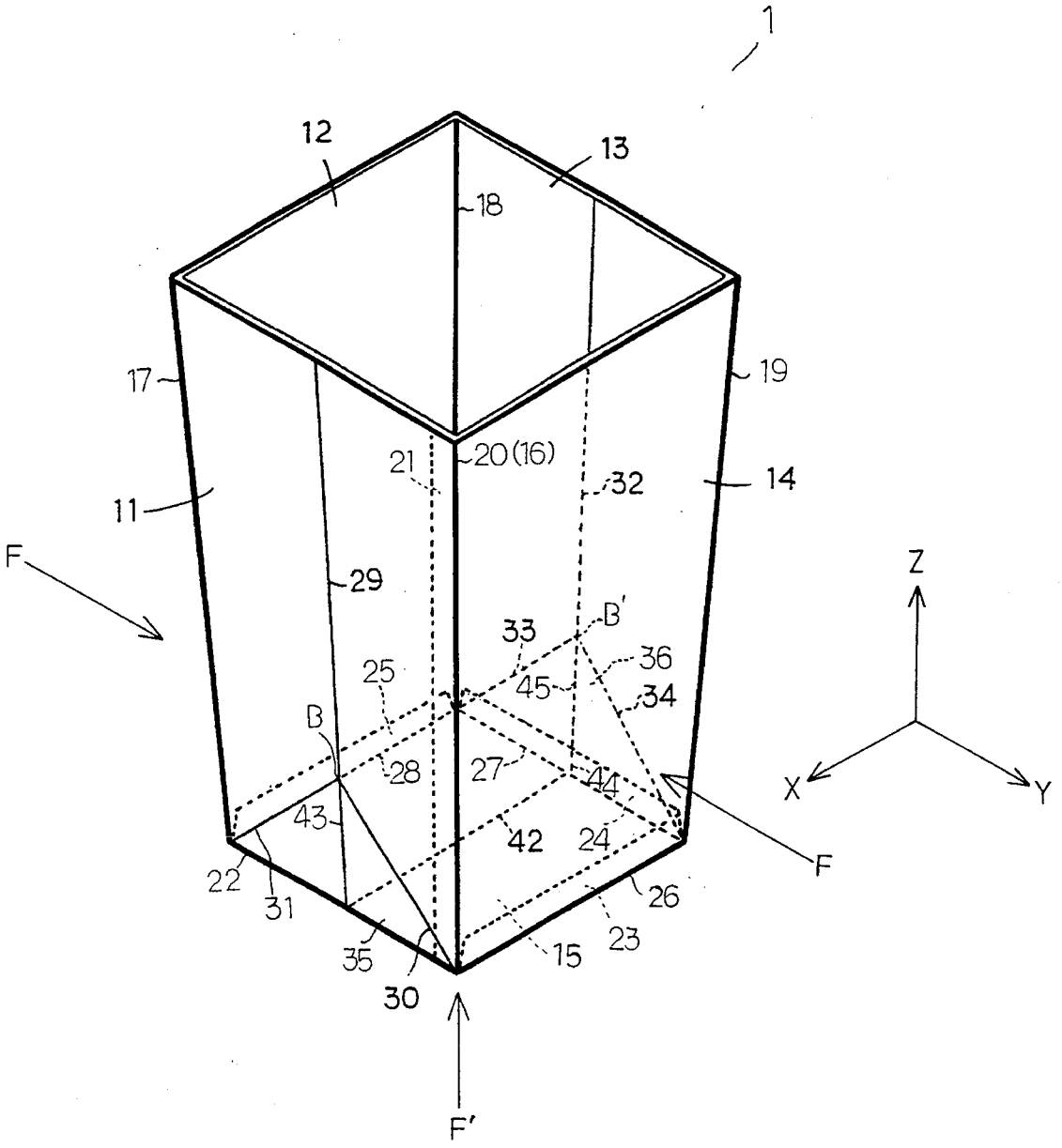
FIG. 4 is the same perspective view of a container with broken lines to show the structures hidden behind.

Referring to FIG. 4, the middle lines (29) (32) and (42) lie in a plane parallel to the XZ-plane. When a compression (F) and a compression (F') is respectively applied to the two opposite side walls (12) (14) and the bottom (15), the side walls (11) (13) will fold outwardly along their middle lines (29) (32) and the bottom (15) will fold inwardly from its middle line (42). The simultaneous outward and inward movements of the middle lines (29) (32) and (42) cause the two isosceles triangles (35) (36) to fold up inwardly until the container is completely flattened (see FIG. 2) into a planar structure.

It is noteworthy that the upper section of each of the middle lines (29) (32) above the apexes (B) (B') of the isosceles triangles (35) (36) and the folding guiders (30) (31) (33) (34) are mechanically treated for an outward folding, while their lower sections (43) (45) below the apexes (B) (B'), just like the middle line (42) are treated for an inward folding.

Since a fold also occurs at the middle part of the tab (24) during the crushing of the container, a corresponding folding guider (44) is provided. The folding guider (44) is treated for inward folding.

In production, the blank in FIG. 1 is folded into a container in FIG. 4 and the side walls and the bottom are bound to the tabs (21) (23) (24) (25) to hold their adjacent sides together, and the seams between the walls and bottom are subject to sealing treatment to offer them a water-or air-tightness, if the container is for containing liquid. Then the container is collapsed into the planar shape in FIG. 2 to facilitate its carrying storage and transportation.

In use, the planar structure can be easily erected by applying a compression (A) in X direction (see FIG. 2) with two fingers on the apexes (B) (B') to open the planar structure into a cup. After use, referring to FIG. 4, the container can be easily crushed back into the planar structure by applying a compression force (F) with two fingers on the lower margin of the side walls (12) (14), and one finger (ideally index) on bottom (15) with an inward force (F') in Z direction [actually, the finger (or index) is right on the middle line (42) of the bottom (15)].

During the opening or the collapsing/crushing movement of the container, the two isosceles triangular areas (35) (36) play a very important role. In the course of the movement they are not planar, but fold with the opening or crushing force, just like a butterfly flaps its wings. To further facilitate the folding movement, short scores (38) (39) are provided along the lower sections of middle lines (43) (45) (see FIG. 5). Of course, like scores can also be provided along the whole length of the folding guider (43) (45) to reach the other folding guiders (30) (31) (33) and (34), that is, to cover the full areas of the isosceles triangles (35) and (36).

Figure 5:
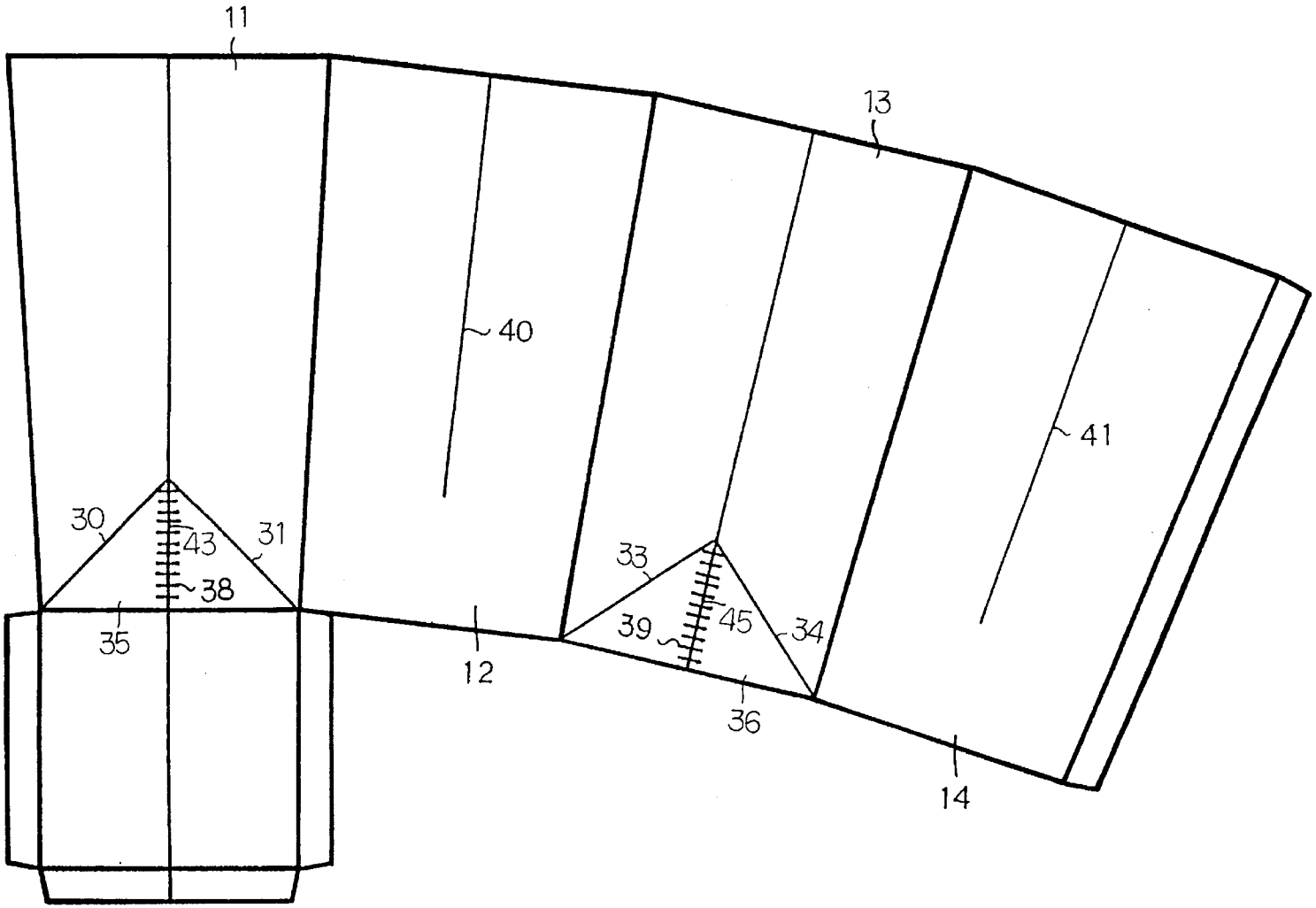
FIG. 5 is a plan view of a blank of a container according to a second embodiment.
Figure 6:
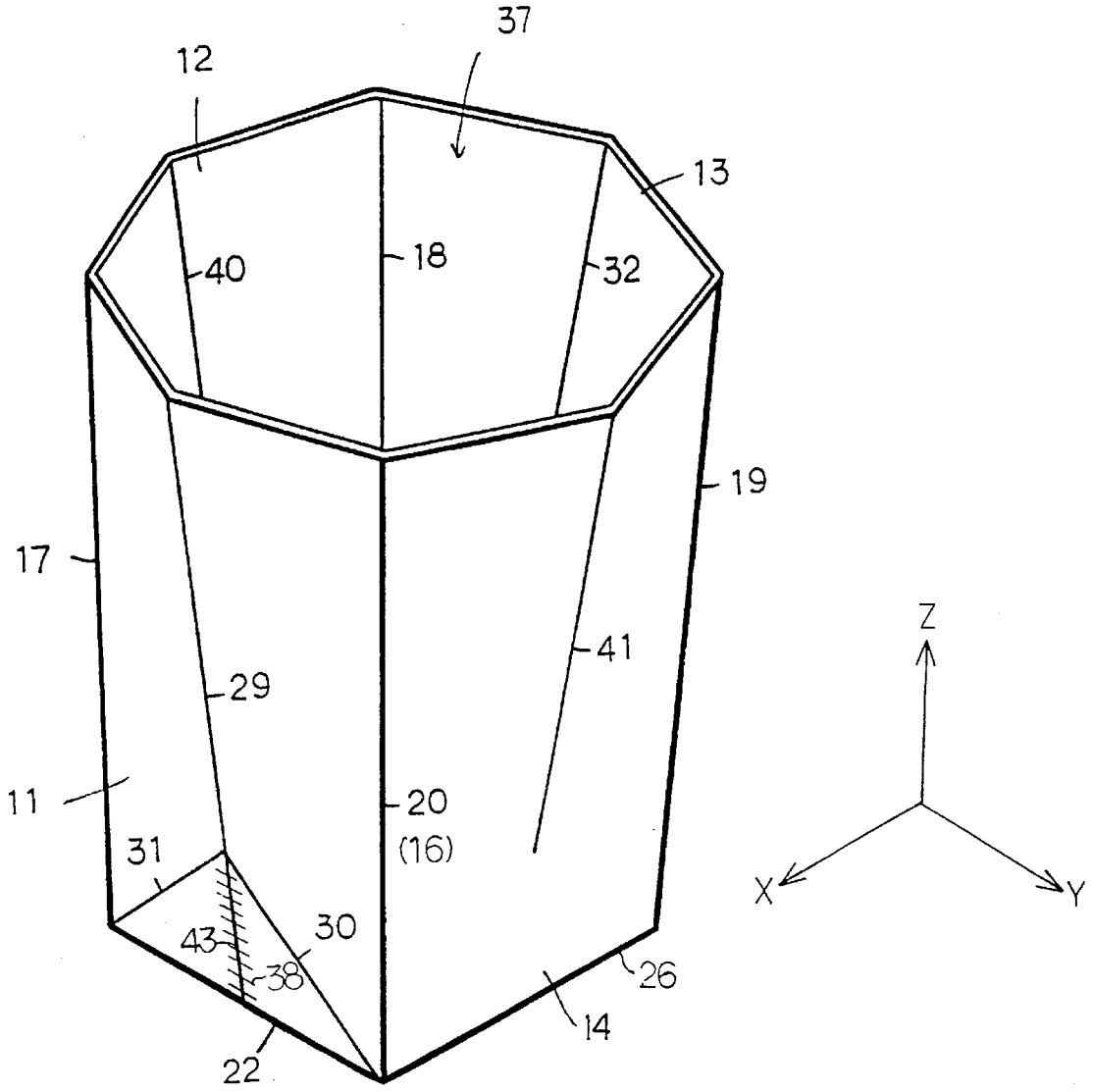
FIG. 6 is a perspective view of a container of the second embodiment in erected state.

In the embodiment of FIG. 5, the two opposite side walls (12) (14) are also provided with a respective folding guider (40) (41) which extends a portion or full length of their middle lines or further provided with other folding guiders similar to that of (30) (31) (33) (34) and (43) (45) in side walls (11) (13). Thus the blank in FIG. 5 can be folded into a cup having an octagonal brim (see FIG. 6) which is closer to a circle than a tetragon, and therefore more comfortable to hold in the hand.

Figure 7:
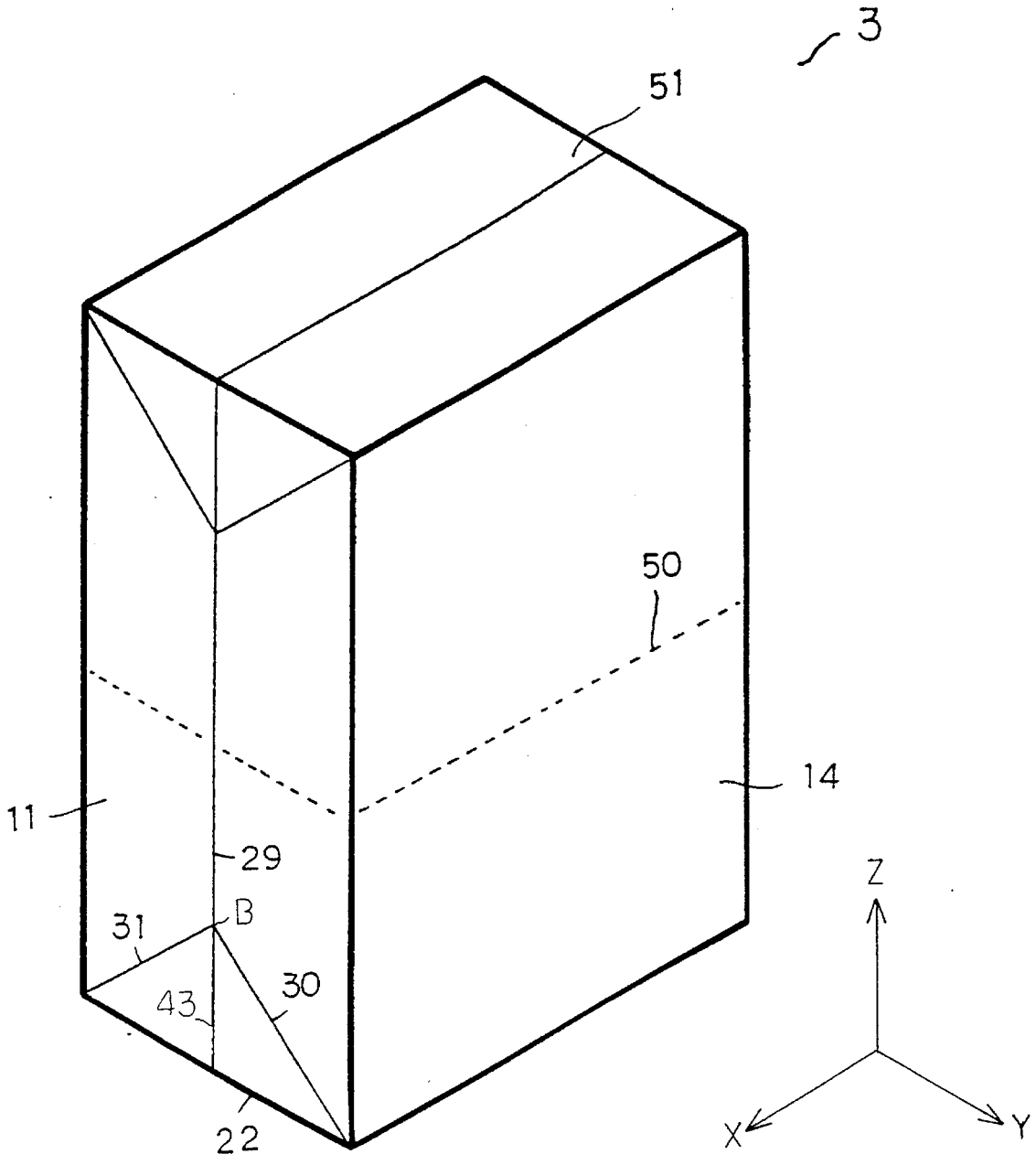
FIG. 7 is a perspective view of a third embodiment with a top bottom.
Figure 8:
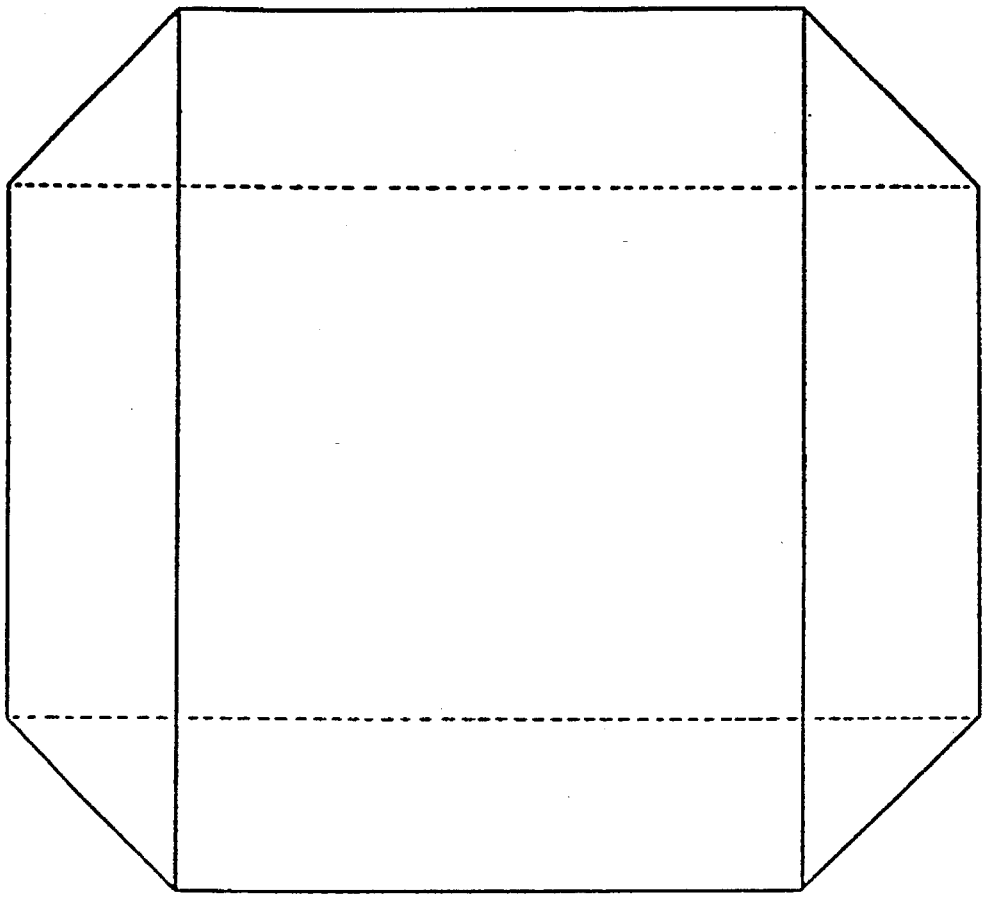
FIG. 8 is a plan view of the third embodiment in collapsed or crushed state.

The embodiment in FIG. 7 is a close-type rectangular container according to this invention. The upper half above an imaginary line (50) is exactly the same as the lower half. The container can be likewise easily collapsed or crushed into a planar structure as shown in FIG. 8.

Figure 9:
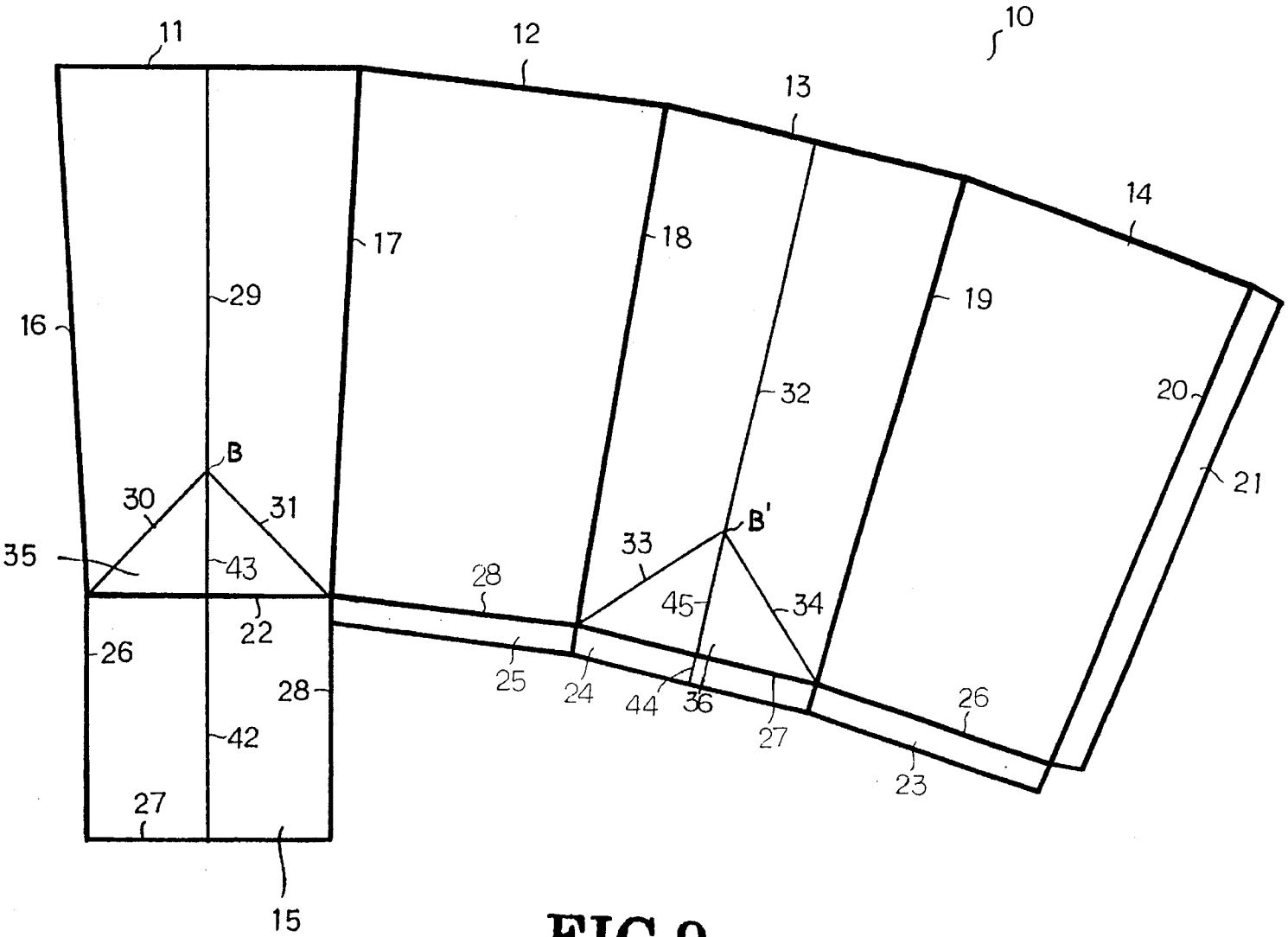
FIG. 9 is a plan view of a fourth embodiment showing different positions of tabs.

FIG. 9 illustrates a blank of a container similar to the embodiment in FIG. 1, with the only difference that the tabs (23) (24) (25) are not provided at the three free sides of the bottom (15), but at the bottom sides of the side walls (12) (13) (14).

Figure 10:
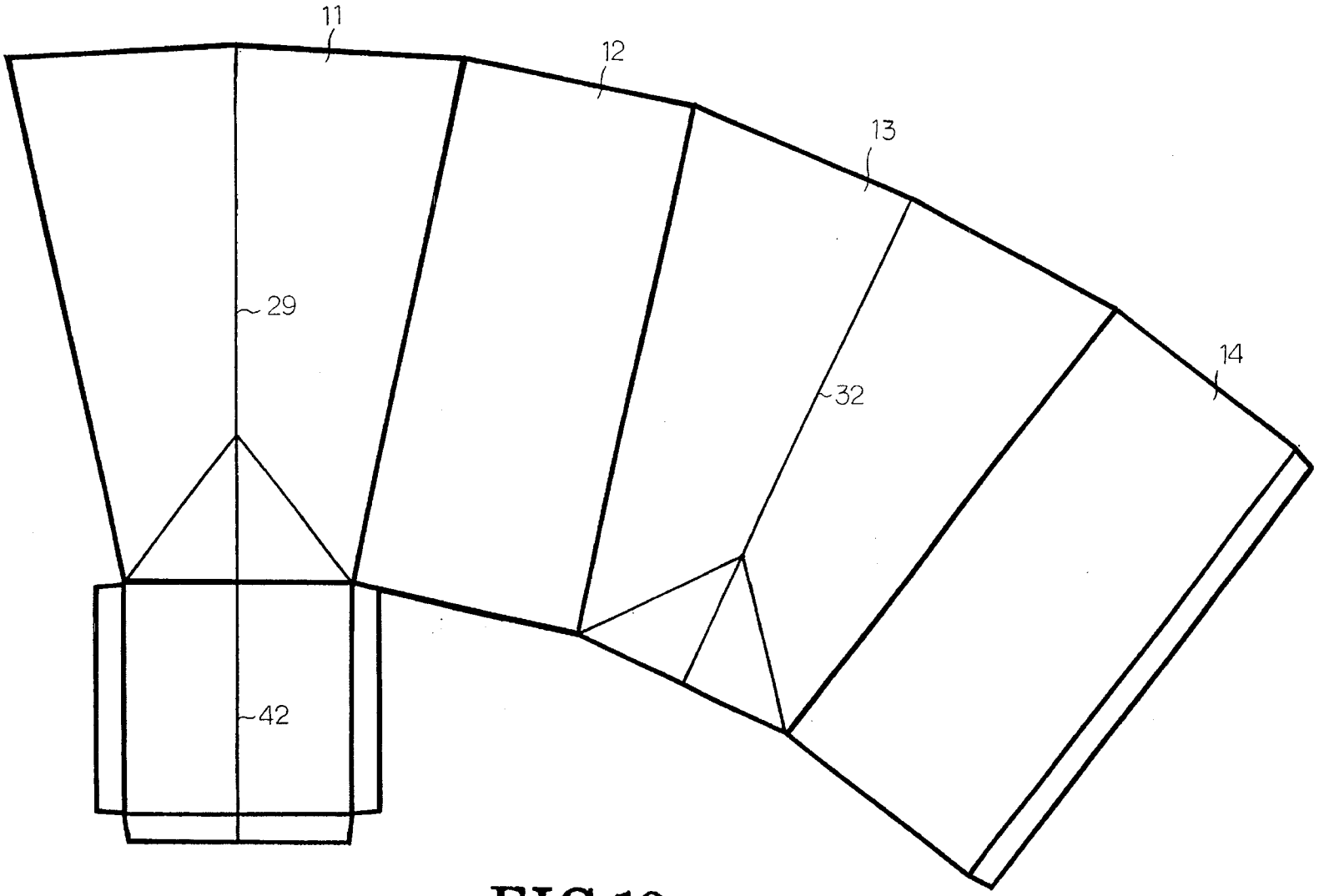
FIG. 10 is a plan view of a blank of a fifth embodiment having a hexagonal brim.
Figure 11:
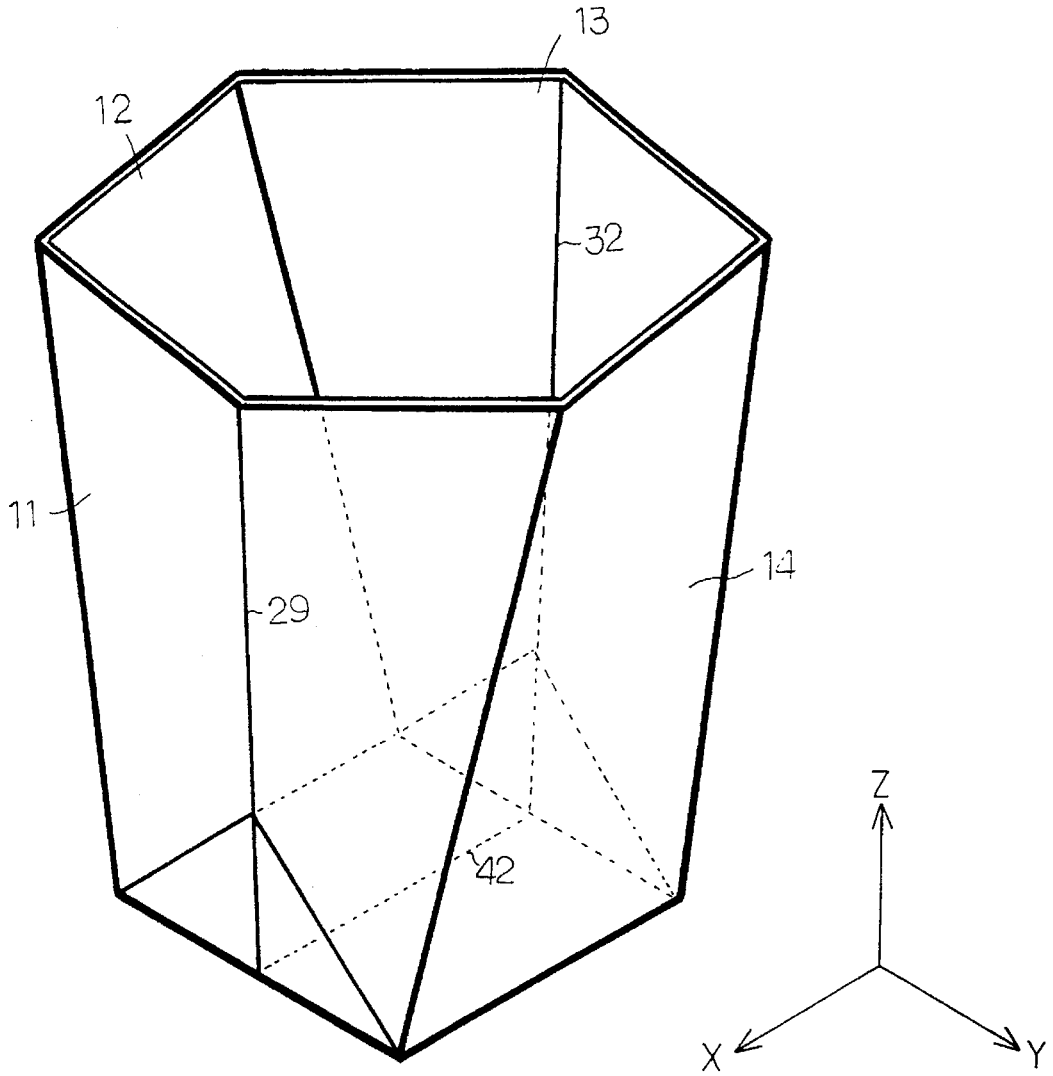
FIG. 11 is a perspective view of a container of the fifth embodiment.

FIG. 10 illustrates a blank which can be folded into a cup having a hexagonal brim (see FIG. 11).

In all the variants, the middle lines (29) (42) and (32) lie in a common vertical plane parallel to the XZ-plane, when the container is erected and laid on a horizontal plane (XY).

I claim:

1. A container formed by sheet material, said container comprising:

a bottom having the shape of a tetragon having four interior angles equal to 90°, a first pair of opposite side walls, and a second pair of opposite side walls having an upper part and a lower part, folding guiders to facilitate said container to be folded up into a planar structure, said folding guiders being provided along a respective middle line of each of said second pair of opposite side walls, along a middle line of said bottom extending continuously between said folding guiders of said second pair of opposite side walls and along each of two equal legs of two respective isosceles triangles defined by two isosceles triangular zones located at said lower part of said second pair of opposite side walls with a base of said isosceles triangles being coincident with a bottom edge of said second pair of opposite side walls, at least part of said folding guiders located in said two respective isosceles triangles being further provided with spaced parallel scores perpendicular thereto, said spaced parallel scores extending only partially across said two respective isosceles triangles located at said lower part of said second pair of opposite side walls.

2. The container according to claim 1, wherein said folding guiders being further provided along a respective middle line of said first pair of opposite side walls at least from a top edge of said walls for at least part of the length thereof.

3. The container according to claim 1, wherein an upper section of each of the folding guiders in said upper part of said second pair of opposite sides walls above the apexes of the legs of the isosceles triangles are mechanically treated for an outward folding, while said folding guiders in said lower part of said second pair of opposite sides walls below the apexes are treated for an inward folding.

4. A container comprising:

a bottom having a shape of a tetragon, a first pair of opposite sides walls extending from said bottom, a second pair of opposite sides walls extending from said bottom, said second pair of opposite sides walls having an upper part and a lower part, and folding guiders positioned to fold the container into a planar structure, said folding guiders extending continuously along a middle line of one of said second pair of opposite side walls, across a middle line of said bottom and along a middle line of the other of said second pair of opposite sides walls, and also along each of two legs of two respective isosceles triangles located at said lower part of said second pair of opposite sides walls with an apex of said two respective isosceles triangles positioned on said middle lines of said second pair of opposite side walls and spaced from said bottom, at least part of said folding guiders located in said two respective isosceles triangles being further provided with spaced parallel scores perpendicular thereto, said spaced parallel scores extending only partially across said two respective isosceles triangles located at said lower part of said second pair of opposite side walls.

5. The container according to claim 4, wherein said folding guiders being further provided along a respective middle line of said first pair of opposite side walls at least from a top edge of said walls for at least part of the length thereof.

6. The container according to claim 4, wherein an upper section of each of the folding guiders in said upper part of said second pair of opposite sides walls above the apexes of the legs of the isosceles triangles are mechanically treated for an outward folding, while said folding guiders in said lower part of said second pair of opposite sides walls below the apexes are treated for an inward folding.

7. A container comprising:

a bottom having four sides, a first pair of opposite sides walls extending from said bottom, a second pair of opposite sides walls extending from said bottom and connected with said first pair of opposite sides walls, and fold lines extending along a middle of said second pair of opposite sides walls, a middle of said bottom, and two legs of two respective isosceles triangles located at a lower part of said second pair of opposite side walls with an apex of said two respective isosceles triangles located along said fold lines of said second pair of opposite side walls for folding of said second pair of opposite side walls and said bottom into a planar structure at least part of said folding guiders located in said two respective isosceles triangles being further provided with spaced parallel scores perpendicular thereto, said spaced parallel scores extending only partially across said two respective isosceles triangles located at said lower part of said second pair of opposite side walls.

8. The container according to claim 7, wherein said fold lines being further provided along a respective middle line of said first pair of opposite side walls at least from a top edge of said walls for at least part of the length thereof.

9. The container according to claim 7, wherein an upper section of each of the fold lines in said upper part of said second pair of opposite sides walls above the apexes of the legs of the isosceles triangles are mechanically treated for an outward folding, while said folding guiders in said lower part of said second pair of opposite sides walls below the apexes are treated for an inward folding.

* * * * *